US009323209B1

(12) United States Patent
Ohata

(10) Patent No.: US 9,323,209 B1
(45) Date of Patent: Apr. 26, 2016

(54) IMAGE FORMING APPARATUS

(71) Applicant: KYOCERA Document Solutions Inc., Osaka (JP)

(72) Inventor: Shinobu Ohata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/884,018

(22) Filed: Oct. 15, 2015

(30) Foreign Application Priority Data

Oct. 16, 2014 (JP) ..... 2014-211300

(51) Int. Cl.
*G03G 15/00* (2006.01)

(52) U.S. Cl.
CPC ..... *G03G 15/80* (2013.01)

(58) Field of Classification Search
CPC ..... G03G 15/80; G03G 21/1652; G03G 2221/166
See application file for complete search history.

(56) References Cited

U.S. PATENT DOCUMENTS 6,907,206 B2 * 6/2005 Hattori ..... G03G 15/80 399/107
8,750,745 B2 * 6/2014 Fujiwara ..... G03G 15/80 399/88
9,188,947 B2 * 11/2015 Kobayashi ..... G03G 21/1647

FOREIGN PATENT DOCUMENTS

JP 2013-250326 A 12/2013

* cited by examiner

*Primary Examiner* — Gregory H Curran
(74) *Attorney, Agent, or Firm* — Studebaker & Brackett PC

(57) ABSTRACT

An image forming apparatus includes a unit, a main high-voltage board, a sub high-voltage board and a connecting mechanism. The connecting mechanism is configured to electrically connect the main high-voltage board and the sub high-voltage board with the unit. The connecting mechanism includes a first connecting member and a second connecting member. The first connecting member includes a main-side terminal configured to be connectable with the main high-voltage board, a unit-side terminal configured to be connectable with the unit and a first conductive wire configured to connect the main-side terminal with the unit-side terminal. The second connecting member includes a sub-side terminal configured to be connectable with the sub high-voltage board, a relay terminal configured to be connectable with the first conductive wire and a second conductive wire configured to connect the sub-side terminal with the relay terminal.

9 Claims, 10 Drawing Sheets

IMAGE FORMING APPARATUS

INCORPORATION BY REFERENCE

This application is based on and claims the benefit of priority from Japanese patent application No. 2014-211300 filed on Oct. 16, 2014, the entire contents of which are incorporated herein by reference.

BACKGROUND

The present disclosure relates to an electrographic image forming apparatus.

Conventionally, an electrographic image forming apparatus includes various units, such as a photosensitive drum unit, a developing unit and a transferring unit, and so on. These units are used for an image forming process on a recording medium.

For example, there is an image forming apparatus including a unit used for an image forming process on a recording medium, a high-voltage board configured to supply a high-voltage current to the unit and a connecting member configured to connect the high-voltage board with the unit.

In the image forming apparatus with such a configuration, there is a case that the high-voltage board configured to supply the high-voltage current to the unit is selectively used according to the model or the like. However, if a plurality of high-voltage boards are respectively connected with the unit by different connecting members, there is a concern that the configuration of the image forming apparatus becomes complicated.

SUMMARY

In accordance with an embodiment of the present disclosure, an image forming apparatus includes a unit, a main high-voltage board, a sub high-voltage board and a connecting mechanism. The unit is used for an image forming process on a recording medium. The main high-voltage board and the sub high-voltage board are configured to supply a high-voltage current to the unit. The connecting mechanism is configured to electrically connect the main high-voltage board and the sub high-voltage board with the unit. The connecting mechanism includes a first connecting member and a second connecting member. The first connecting member includes a main-side terminal configured to be connectable with the main high-voltage board, a unit-side terminal configured to be connectable with the unit and a first conductive wire configured to connect the main-side terminal with the unit-side terminal. The second connecting member includes a sub-side terminal configured to be connectable with the sub high-voltage board, a relay terminal configured to be connectable with the first conductive wire and a second conductive wire configured to connect the sub-side terminal with the relay terminal.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
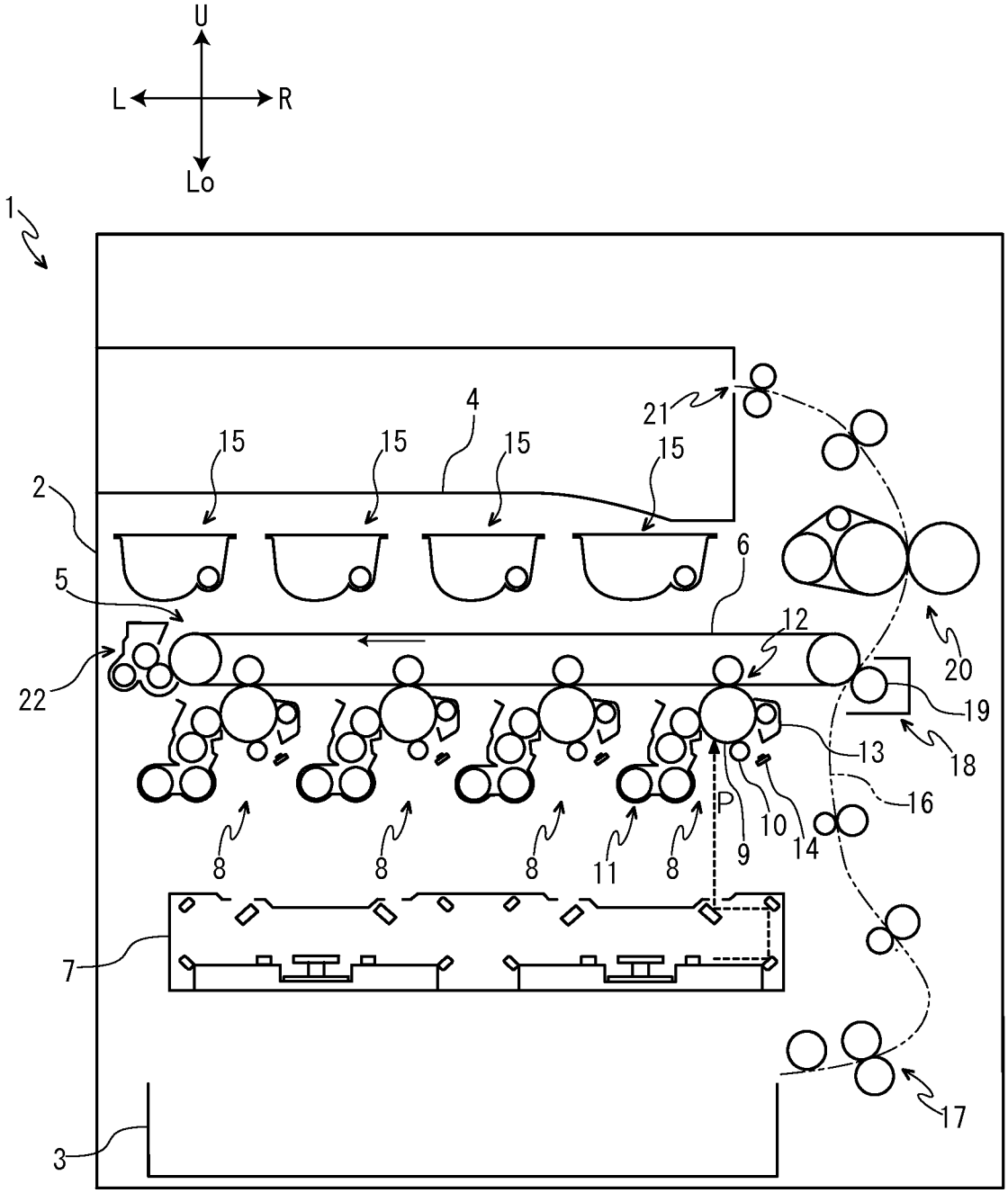
FIG. 1 is a schematic diagram showing an outline of a configuration of a color printer according to an embodiment of the present disclosure.

Firstly, with reference to FIG. 1, the entire structure of a color printer 1 (an image forming apparatus) will be described. Hereinafter, a near side of FIG. 1 will be described as a front side of the color printer 1, for convenience of explanation. Arrows Fr, Rr, L, R, U and Lo of each figure indicate a front side, a rear side, a left side, a right side, an upper side and a lower side of the color printer 1, respectively.

The color printer 1 includes a box-formed printer main body 2. In a lower part of the printer main body 2, a sheet feeding cartridge 3 storing a sheet (a recording medium) is arranged. In an upper part of the printer main body 2, an ejected sheet tray 4 is arranged.

In a middle part of the printer main body 2, an intermediate transferring unit 5 (a unit) is arranged. The intermediate transferring unit 5 is provided with an intermediate transferring belt 6 (an image carrier) disposed around a plurality of rollers. Below the intermediate transferring belt 6, an exposure device 7 composed of a laser scanning unit (LSU) is arranged. At a lower side of the intermediate transferring belt 6, four image forming parts 8 are arranged for respective colors (e.g. four colors of magenta, cyan, yellow and black) of a toner. In each image forming part 8, a photosensitive drum 9 is rotatably arranged. Around the photosensitive drum 9, a charger 10, a developing device 11, a primary transferring part 12, a cleaning device 13 and a static eliminator 14 are located in order of first transferring processes. Above the developing device 11, toner containers 15 corresponding to the respective image forming parts 8 are arranged for the respective colors (e.g. four colors of magenta, cyan, yellow and black) of toner.

At a right side part of the printer main body 2, a conveying path 16 for the sheet is arranged in an upper and lower direction. At an upstream end of the conveying path 16, a sheet feeding part 17 is arranged. At an intermediate stream part of the conveying path 16, a secondary transferring unit 18 is arranged at a right end side of the intermediate transferring belt 6. The secondary transferring unit 18 includes a secondary transferring roller 19 (a secondary transferring member). At a downstream part of the conveying path 16, a fixing device 20 is arranged. At a downstream end of the conveying path 16, a sheet ejection port 21 is arranged. At a left end side of the intermediate transferring belt 6, a cleaning unit 22 is arranged.

Next, an image forming process on the sheet in the color printer 1 having such a configuration will be described.

When the power is supplied to the color printer 1, various parameters are initialized and initial determination, such as temperature determination of the fixing device 20, is carried out. Subsequently, when image data is inputted and a printing start is directed from a computer or the like connected with the color printer 1, the image forming process on the sheet is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image in the developing device 11 by the toner supplied from each toner container 15. The toner image is primarily transferred to the surface of the intermediate transferring belt 6 in the primary transferring part 12. The above-mentioned operation is repeated in order by the respective image forming parts 8, thereby forming the toner image of full color on the intermediate transferring belt 6. Incidentally, toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the secondary transferring unit 18. Then, by the secondary transferring roller 19, the toner image of full color on the intermediate transferring belt 6 is secondary transferred to the sheet. The sheet with the secondary transferred toner image is conveyed to a downstream side on the conveying path 16 to enter the fixing device 20, and then, the toner image is fixed on the sheet in the fixing device 20. The sheet with the fixed toner image is ejected from the sheet ejection port 21 on the ejected sheet tray 4. Incidentally, the toner remained on the intermediate transferring belt 6 is removed by the cleaning unit 22.

Next, main parts of the color printer 1 according to the embodiment of the present disclosure in a case where the color printer 1 is used as a high grade model (e.g. a model of a relatively high sheet conveying speed) and in a case where the color printer 1 is used as a low grade model (e.g. a model of a lower sheet conveying speed than the high grade model) will be described.

(The Case where the Color Printer 1 is Used as the High Grade Model)

First, the printer main body 2 and its periphery will be described.

Figure 2:
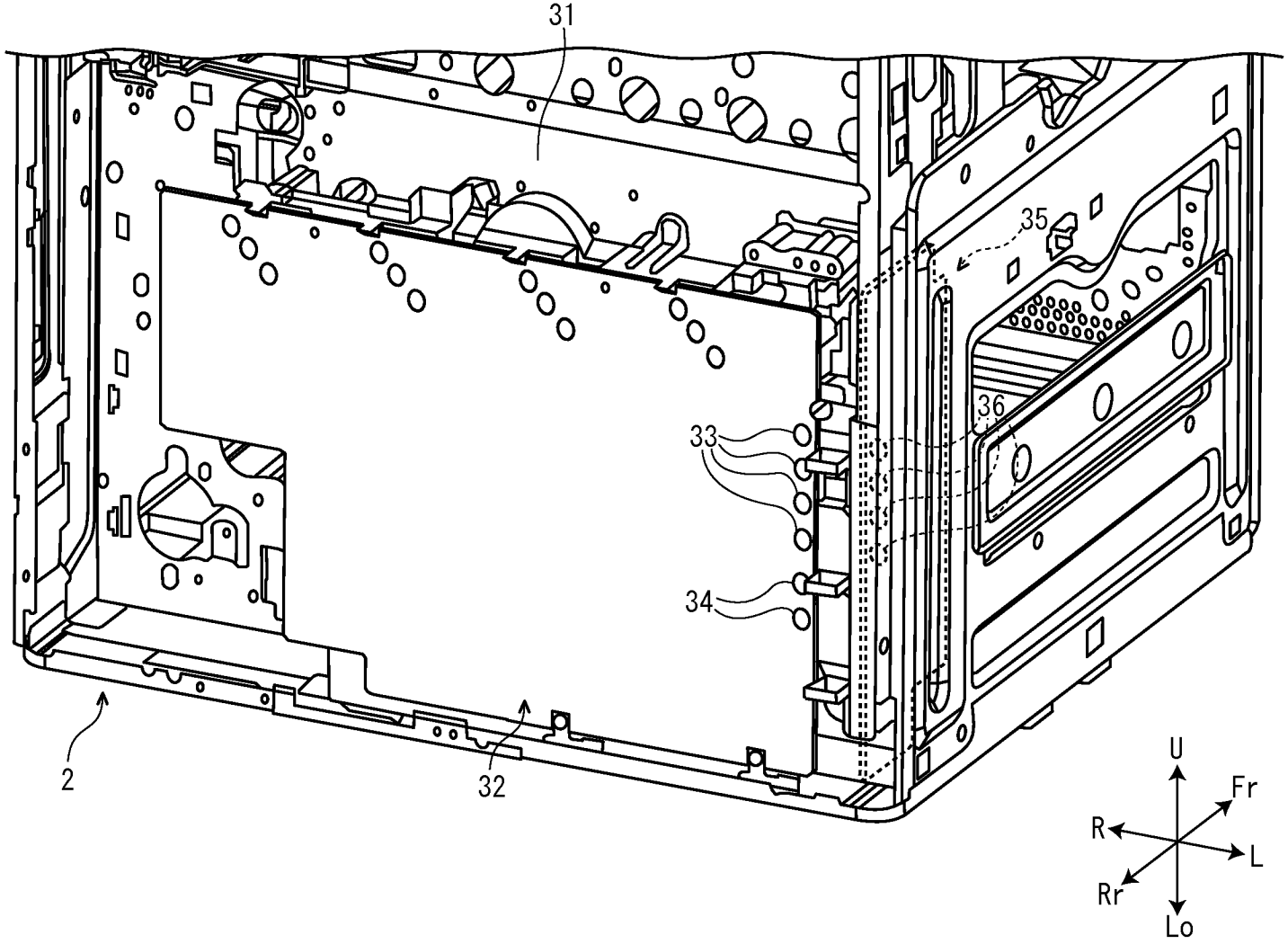
FIG. 2 is a perspective view showing a printer main body and its periphery, in a case where the color printer according to the embodiment of the present disclosure is used as a high grade model.

As shown in FIG. 2, at a rear part of the printer main body 2, a rear frame 31 is set up. The rear frame 31 is provided to divide an internal space of the printer main body 2 into front and rear spaces.

At a rear end part of the printer main body 2, a main high-voltage board 32 (a main high-voltage board of one type) is set up. The main high-voltage board 32 is provided in parallel to the rear frame 31. At a left end part of the main high-voltage board 32, four first main contact points 33 are provided in a row in an upper and lower direction. A circuit pattern (conductor pattern) of the main high-voltage board 32 does not reach each first main contact point 33. At the left end part of the main high-voltage board 32, and below each first main contact point 33, two second main contact points 34 are provided in a row in the upper and lower direction. The circuit pattern (conductor pattern) of the main high-voltage board 32 reaches each second main contact point 34.

At a rear left corner part of the printer main body 2, a sub high-voltage board 35 is set up. The sub high-voltage board 35 is provided at a left side of the main high-voltage board 32, and adjacent to the main high-voltage board 32. At a rear end part of the sub high-voltage board 35, four sub contact points 36 are provided in a row in the upper and lower direction. A circuit pattern (conductor pattern) of the sub high-voltage board 35 reaches each sub contact point 36.

Next, a connecting mechanism 40 which electrically connects the main high-voltage board 32 and the sub high-voltage board 35 with the intermediate transferring unit 5 will be described.

Figure 3:
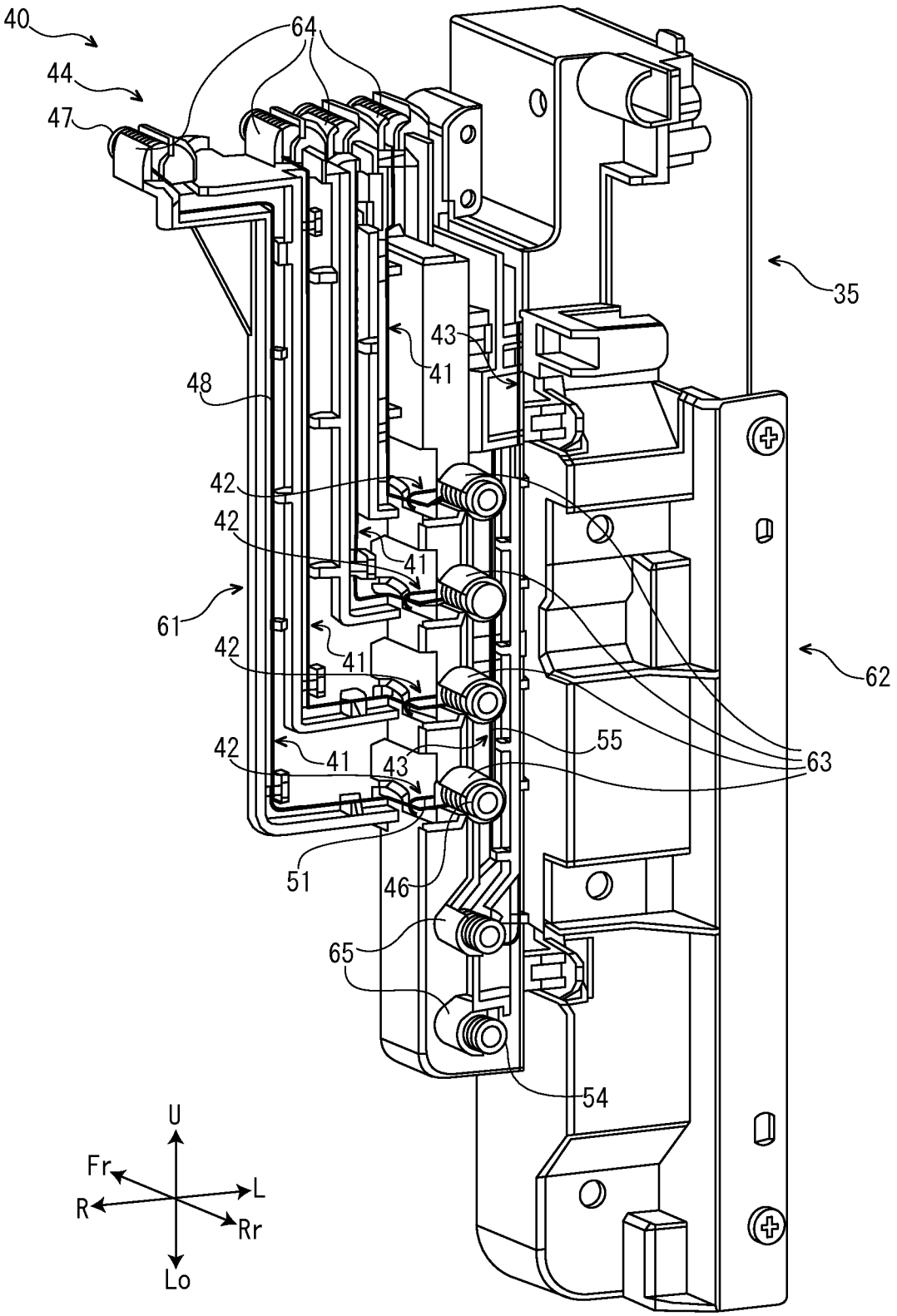
FIG. 3 is a perspective view seen from a right rear side and showing a connecting mechanism, in the case where the color printer according to the embodiment of the present disclosure is used as the high grade model.
Figure 4:
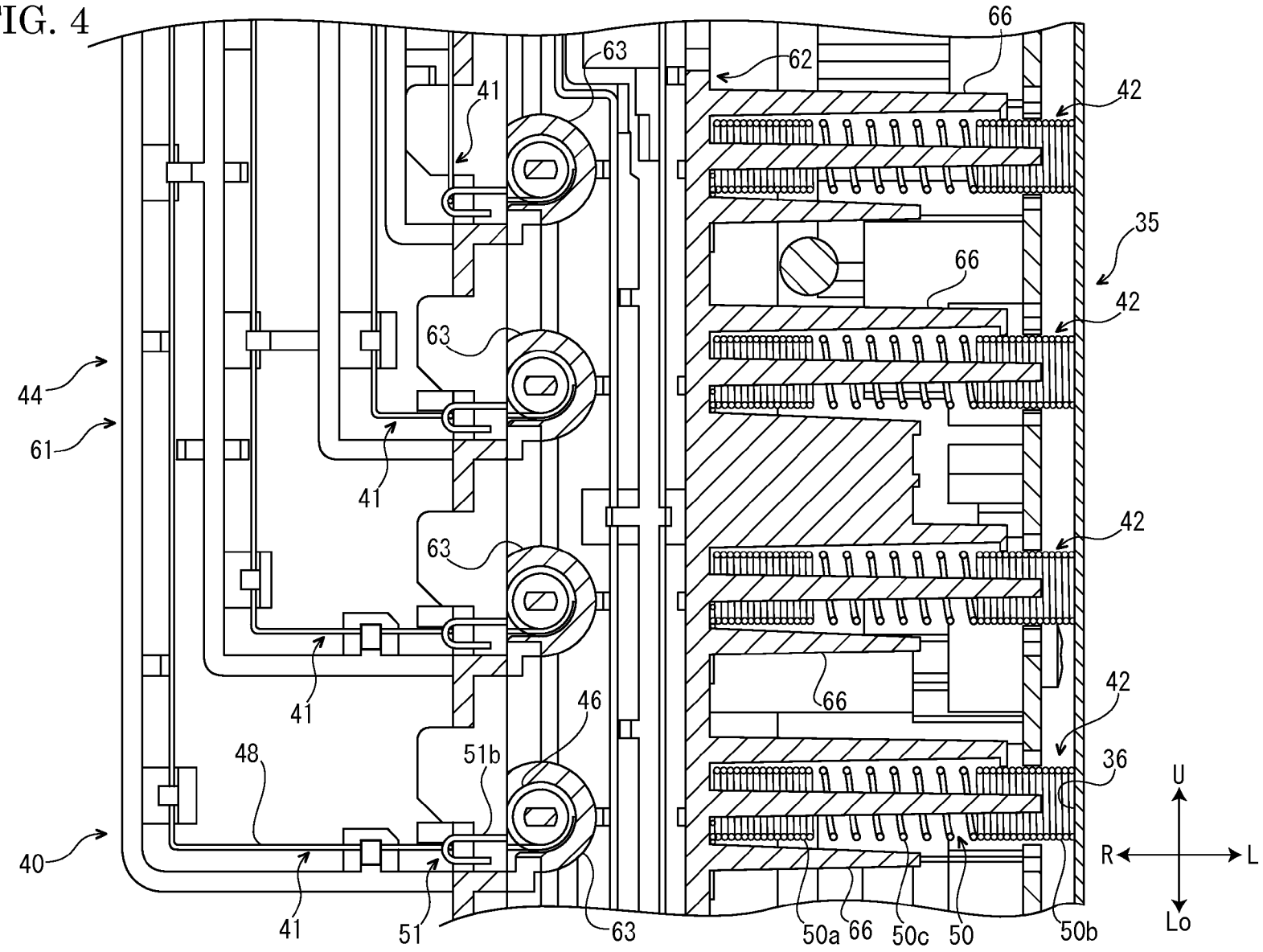
FIG. 4 is a sectional view showing the connecting mechanism, in the case where the color printer according to the embodiment of the present disclosure is used as the high grade model.

As shown in FIGS. 3 and 4, the connecting mechanism 40 includes four first connecting members 41, four second connecting members 42 which are arranged at a left side of each first connecting member 41, two third connecting members 43 which are arranged from a lower side to a left side of each first connecting member 41, and a holding member 44 which holds each first connecting member 41, each second connecting member 42 and each third connecting member 43.

Each first connecting member 41 is made of a conductive metal wire, for example. As shown in FIG. 3, each first connecting member 41 includes a main-side terminal 46, a unit-side terminal 47 which is arranged above the main-side terminal 46, and a first conductive wire 48 which connects the main-side terminal 46 with the unit-side terminal 47.

The main-side terminal 46 of each first connecting member 41 is formed by a coil spring. The main-side terminal 46 of each first connecting member 41 is in contact with each first main contact point 33 (see FIG. 2) of the main high-voltage board 32. Meanwhile, the circuit pattern of the main high-voltage board 32 does not reach each first main contact point 33 as described above, and therefore the main-side terminal 46 of each first connecting member 41 is not electrically connected with the main high-voltage board 32.

As shown in FIG. 3, the unit-side terminal 47 of each first connecting member 41 is formed by a coil spring. The unit-side terminal 47 of each first connecting member 41 is directly or indirectly connected with the intermediate transferring unit 5.

Figure 5:
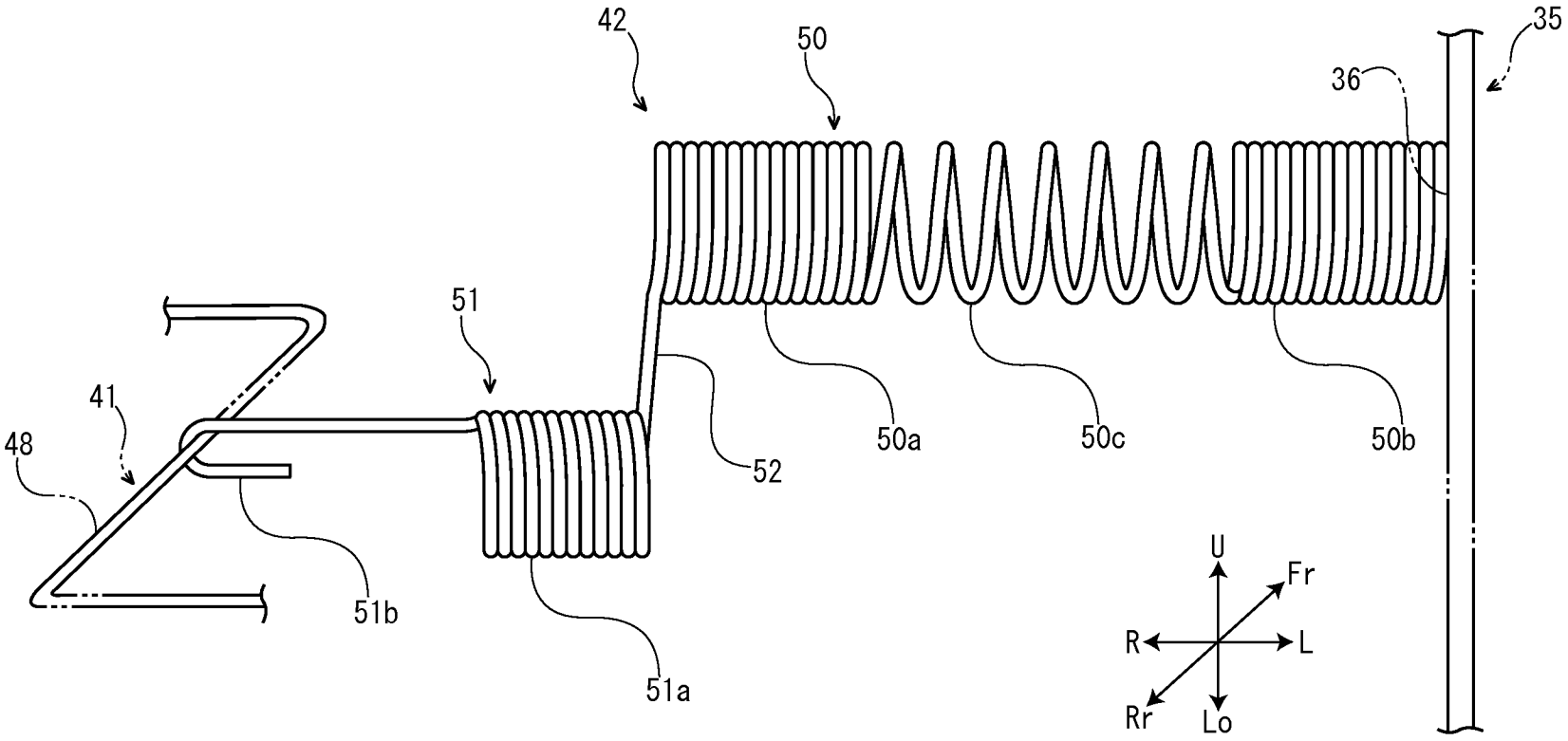
FIG. 5 is a perspective view showing a second connecting member, in the case where the color printer according to the embodiment of the present disclosure is used as the high grade model.

Each second connecting member 42 is made of a conductive metal wire, for example. As shown in FIG. 5, each second connecting member 42 includes a sub-side terminal 50, a relay terminal 51 which is arranged closer to a right side than the sub terminal 50, and a second conductive wire 52 which connects the sub-side terminal 50 and the relay terminal 51.

A right end part 50*a* (proximal end part) and a left end part 50*b* (distal end part) of the sub-side terminal 50 of each second connecting member 42 are formed by tightly wound coil springs (coil springs whose each winding part comes in contact with each other tightly), and are not compressible in a left and right direction (an axis center direction). A left-and-right direction center part 50*c* of the sub-side terminal 50 of each second connecting member 42 is formed by a compressible coil spring (coil spring whose each winding part does not come into contact with each other), and is compressible in the left and right direction (axis center direction). The left end part 50*b* of the sub-side terminal 50 of each second connecting member 42 is in contact with each sub contact point 36 of the sub high-voltage board 35. Thus, the sub-side terminal 50 of each second connecting member is electrically connected with the sub high-voltage board 35.

A left side part 51*a* (proximal end side part) of the relay terminal 51 of each second connecting member 42 is formed by a tension coil spring, and can be stretched in the left and right direction (axis center direction). Thus, each second connecting member 42 integrally includes a part formed by a compressible coil spring (the left-and-right direction center part 50*c* of the sub-side terminal 50), and a part formed by a tension coil spring (the left side part 41*a* of the relay terminal 51). A right side part 51*b* (distal end side part) of the relay terminal 51 of each second connecting member 42 is formed by a U-shaped hook, and is hooked on the first conductive wire 48 of each first connecting member 41. Thus, the relay terminal 51 of each second connecting member 42 is electrically connected with the first conductive wire 48 of each connecting member 41.

According to the above-mentioned configuration, the sub high-voltage board 35 is connected with the intermediate transferring unit 5 via each second connecting member 42 and each first connecting member 41.

As shown in FIG. 3, each third connecting member 43 includes a one-side terminal 54, an other-side terminal (not shown) arranged above the one-side terminal 54 and a third conductive wire 55 which connects the one-side terminal 54 with the other-side terminal.

The one-side terminal 54 of each third connecting member 43 is formed by a coil spring. The one-side terminal 54 of each third connecting member 43 is in contact with each second main contact point 34 (see FIG. 2) of the main high-voltage board 32. Thus, the one-side terminal 54 of each third connecting member 43 is electrically connected with the main high-voltage board 32.

The other-side terminal of each third connecting member 43 is formed by a coil spring. The other-side terminal of each third connecting member 43 is connected with the cleaning unit 22 and a pre-bias unit (not shown).

According to the above-mentioned configuration, the main high-voltage board 32 is connected with the cleaning unit 22 and the pre-bias unit (not shown) via each third connecting member 43.

The holding member 44 is made of a resin of a high electric insulating property, for example. As shown in FIGS. 3 and 4, the holding member 44 includes a first holding plate part 61 and a second holding plate part 62 provided at a left side of the first holding plate part 61.

To the first holding plate part 61 of the holding member 44, each first connecting member 41 and each third connecting member 43 are detachably attached. At a left side part of the first holding plate part 61, four main-side housings 63 are provided in a row in the upper and lower direction. In each main-side housing 63, the main-side terminal 46 of each first connecting member 41 is housed. At an upper end part of the first holding plate part 61, four unit-side housings 64 are provided in a row in the left and right direction. In each unit-side housing 64, the unit-side terminal 47 of each first connection member 41 is housed. At a left side part of the first holding plate part 61, and below each main-side housing 63, two one-side housings 65 are provided in a row in the upper and lower direction. In each one-side housing 65, the one-side terminal 54 of each third connecting member 43 is housed.

Figure 6:
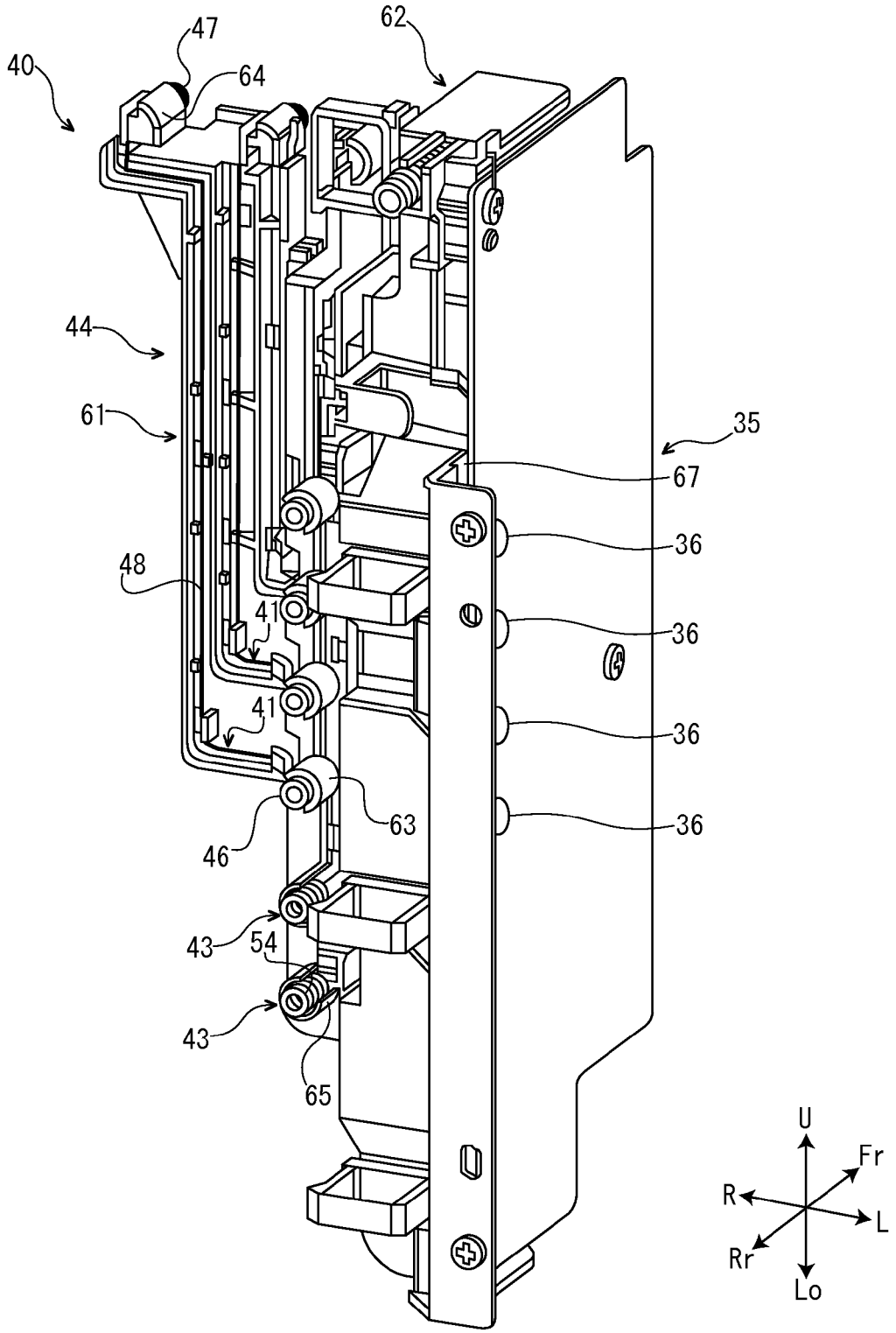
FIG. 6 is a perspective view seen from a left rear side and showing the connecting mechanism, in the case where the color printer according to the embodiment of the present disclosure is used as the high grade model.

To the second holding plate part 62 of the holding member 44, each second connecting member 42 is detachably attached. The second holding plate part 62 is provided vertically to the first holding plate part 61. On the second holding plate part 62, four sub-side housings 66 are provided in a row in the upper and lower direction. In each sub-side housing 66, the sub-side terminal 50 of each second connecting member 42 is housed. As shown in FIG. 6, to a left face (outer face) of the second holding plate part 62, a board attachment part 67 is provided, and, to the board attachment part 67, the sub high-voltage board 35 is detachably attached.

Figure 7A:
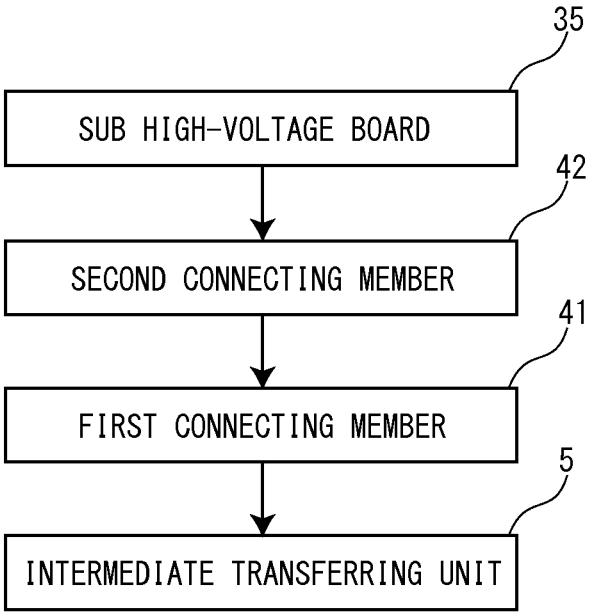
FIGS. 7A and 7B are flow charts showing a flow of a high-voltage current, in the case where the color printer according to the embodiment of the present disclosure is used as the high grade model.
Figure 7B:
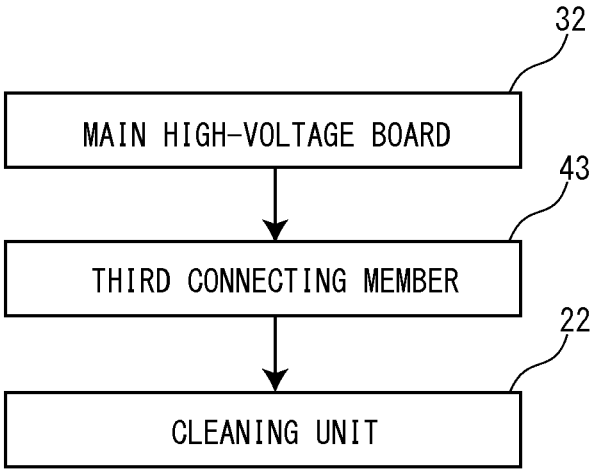

In the color printer 1 applying the above-mentioned configuration, as shown in FIG. 7A, a high-voltage current from the sub high-voltage board 35 is supplied to the intermediate transferring unit 5 via each second connecting member 42 and each first connecting member 41. Meanwhile, as shown in FIG. 7B, the high-voltage current from the main high-voltage board 32 is supplied to the cleaning unit 22 and the pre-bias unit (not shown) via each third connecting member 43.

(The Case where the Color Printer 1 is Used as the Low Grade Model)

Figure 8:
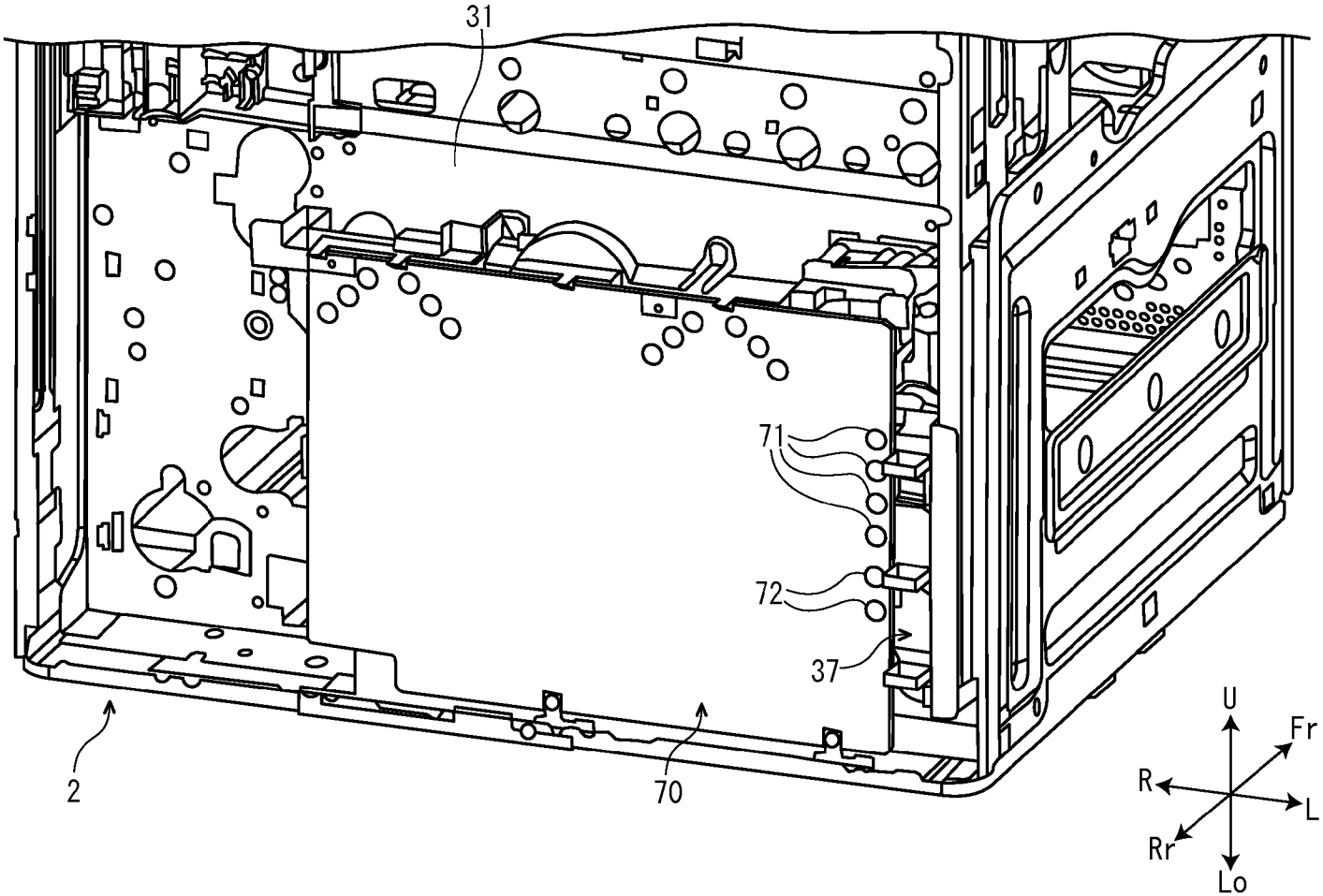
FIG. 8 is a perspective view showing the printer main body and its periphery, in a case where the color printer according to the embodiment of the present disclosure is used as a low grade model.

In this case, as shown in FIG. 8, a main high-voltage board 70 of a different type (a main high-voltage board of another type) from the main high-voltage board 32 used in a case where the color printer 1 is used as the high grade model is used. Thus, in the present embodiment, one of two types of the main high-voltage boards 32, 70 is selectively used.

At a left end part of the main high-voltage board 70, four first main contact points 71 are provided in a row in the upper and lower direction. A circuit pattern (conductor pattern) of the main high-voltage board 70 reaches each first main contact point 71. Hence, when the main-side terminal 46 of each first connecting member 41 comes into contact with each first main contact point 71, the main-side terminal 46 of each first connecting member 41 is electrically connected with the main high-voltage board 70. According to this, the main high-voltage board 70 is connected with the intermediate transferring unit 5 via each first connecting member 41.

At the left end part of the main high-voltage board 70, and below each first main contact point 71, two second main contact points 72 are provided in a row in the upper and lower direction. The circuit pattern (conductor pattern) of the main high-voltage board 70 reaches each second main contact point 72. Hence, when the one-side terminal 54 of each third connecting member 43 comes into contact with each second main contact point 72, the one-side terminal 54 of each third connecting member 43 is electrically connected with the main high-voltage board 70. According to this, the main high-voltage board 70 is connected with the cleaning unit 22 and the pre-bias unit (not shown) via each third connecting member 43.

Figure 9:
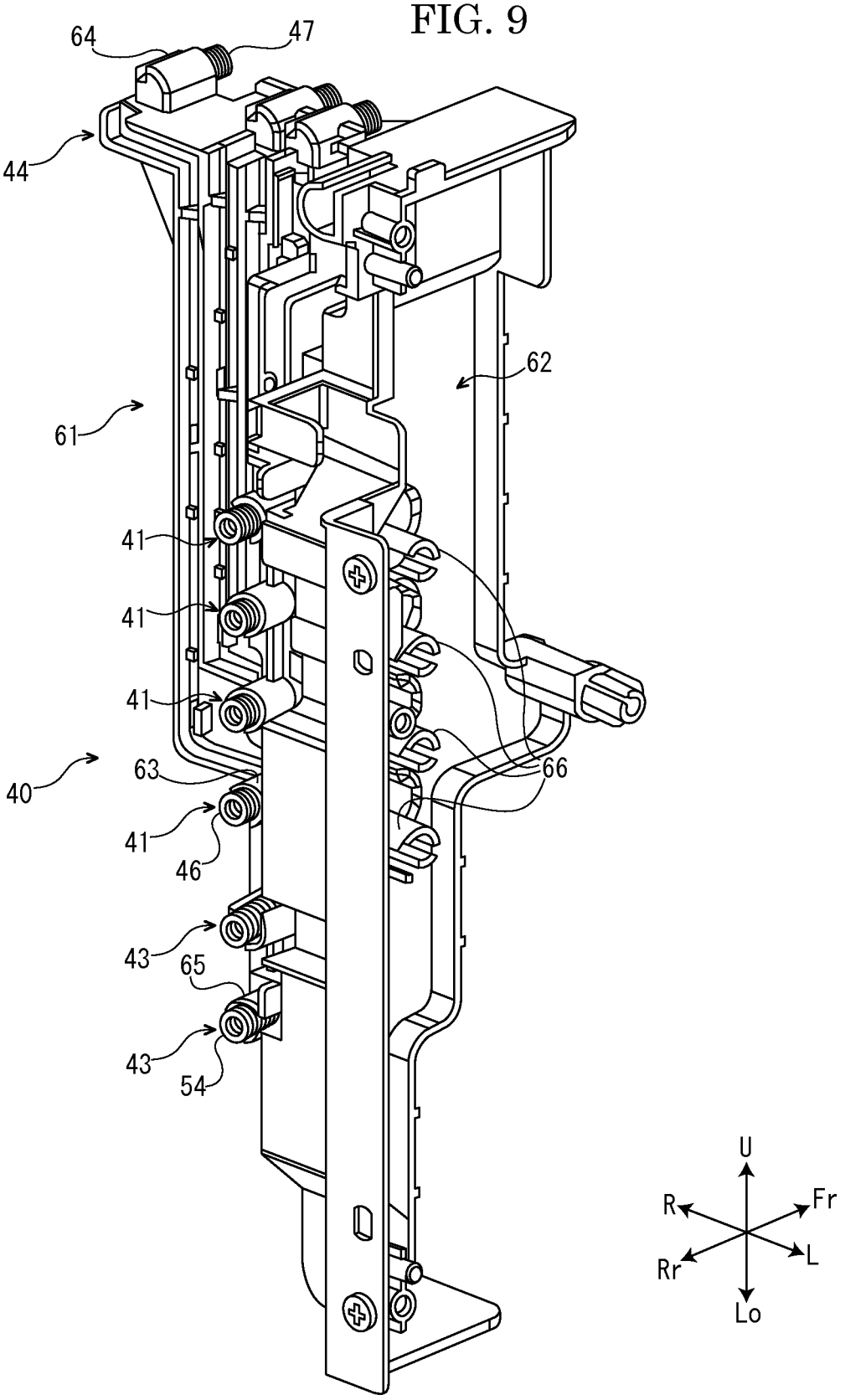
FIG. 9 is a perspective view seen from the left rear side and showing the connecting mechanism, in the case where the color printer according to the embodiment of the present disclosure is used as the low grade model.

As shown in FIG. 9, when the color printer 1 is used as the low grade model, the sub high-voltage board 35 and each second connecting member 42 are not attached to the second holding plate part 62 of the holding member 44.

Figure 10A:
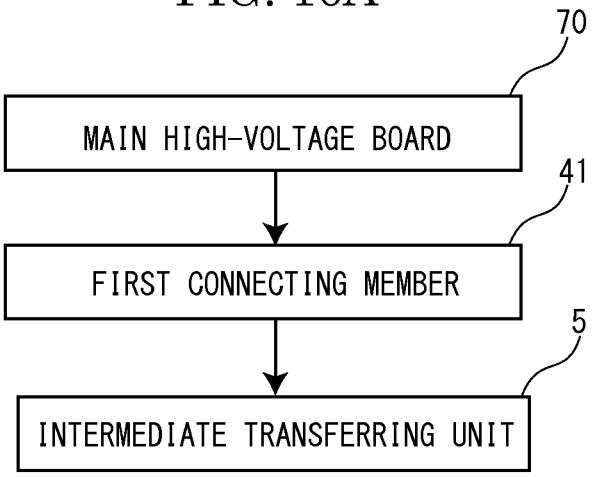
FIGS. 10A and 10B are flow charts showing a flow of a high-voltage current, in the case where the color printer according to the embodiment of the present disclosure is used as the low grade model.
Figure 10B:
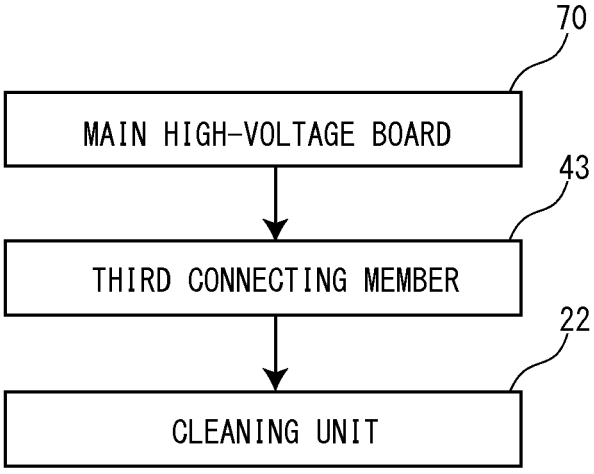

In the color printer 1 applying the above-mentioned configuration, as shown in FIG. 10A, a high-voltage current from the main high-voltage board 70 is supplied to the intermediate transferring unit 5 via each first connecting member 41. Further, as shown in FIG. 10B, a high-voltage current from the main high-voltage board 70 is supplied to the cleaning unit 22 and the pre-bias unit (not shown) via each third connecting member 43.

In the present embodiment, as described above, when the color printer 1 is used as the high grade model (the sub high-voltage board 35 and the intermediate transferring unit 5 are electrically connected), and when the color printer 1 is used as the low grade model (the main high-voltage board 70 and the intermediate transferring unit 5 are electrically connected), each first connecting member 41 and the holding member 44 are used. According to this, it is possible to selectively use a high-voltage board which supplies a high-voltage current to the intermediate transferring unit 5 while preventing the configuration of the color printer 1 from becoming complicated.

Further, the main high-voltage board of one of a plurality of types is configured to be selectively used, and, in a state where the main high-voltage board 32 is used, the main-side terminal 46 of each first connecting member 41 is not connected with the main high-voltage board 32 and the sub high-voltage board 35 is connected with the intermediate transferring unit 5 via each second connecting member 42 and each first connecting member 41 and, in a state where the main high-voltage board 70 is used, the main-side terminal 46 of each first connecting member 41 is connected with the main high-voltage board 70 and the main high-voltage board 70 is connected with the intermediate transferring unit 5 via each first connecting member 41. By applying this configuration, it is possible to selectively use a high-voltage board which supplies a high-voltage current to the intermediate transferring unit 5 easily.

Further, the sub high-voltage board 35 and each second connecting member 42 are detachably attached to the holding member 44 which holds each first connecting member 41 and each third connecting member 43. By applying this configuration, it is not necessary to provide a member, to which the sub high-voltage board 35 and each second connecting member 42 are attached, separately from the holding member 44. According to this, it is possible to prevent an increase in the number of parts, and simplify the configuration of the color printer 1.

Further, the sub high-voltage board 35 is provided at the left side of the main high-voltage board 32 and adjacent to the main high-voltage board 32. By applying this configuration, it is possible to make the connecting mechanism 40 compact, and, according to this, it is possible to increase the flexibility of design of members arranged around the connecting mechanism 40.

Further, when a tension coil spring and a compressible coil spring which are separately provided are connected so as to form each second connecting member 42, there is a concern that a connection failure of the tension coil spring and the compressible coil spring occurs. To avoid such a connection failure, it is necessary to use housings with complicated shapes and, according to this, manufacturing cost of the connecting mechanism 40 rises.

However, in the present embodiment, the sub-side terminal 50 of each second connecting member 42 is partially formed by a compressible coil spring, and the relay terminal 51 of each second connecting member 42 is partially formed by a tension coil spring. That is, each second connecting member 42 of one element has a function of the compressible coil spring and the tension coil spring. Hence, compared to a case where a compressible coil spring and a tension coil spring which are separately provided are connected, it is possible to reduce the number of parts and manufacture the color printer 1 at low cost.

Further, the intermediate transferring unit 5 including the intermediate transfer belt 6 is used as a unit. Hence, it is possible to reliably supply the high-voltage current from the main high-voltage board 70 or the sub high-voltage board 35 to the intermediate transferring unit 5.

In the present embodiment, the sub high-voltage board 35 and each second connecting member 42 are attached to the holding member 44 which holds each first connecting member 41 and each third connecting member 43. In another embodiment, the sub high-voltage board 35 and each second connecting member 42 may be attached to a member provided separately from the holding member 44 which holds each first connecting member 41 and each third connecting member 43.

In the present embodiment, the intermediate transferring unit 5 including the intermediate transferring belt 6 is used as a unit. In another embodiment, an exposure unit including the exposure device 7, a photosensitive drum unit including the photosensitive drum 9, a developing unit including the developing device 11, the secondary transferring unit including the secondary transferring roller 19 or a fixing unit including the fixing device 20 or the like may be used as a unit. That is, every unit which is used for an image forming process on the sheet may be used as a unit.

In the present embodiment, the configuration of the present disclosure is applied to the color printer 1. In another embodiment, the configuration of the present disclosure may be applied to another image forming apparatus, such as a monochrome printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a unit used for an image forming process on a recording medium;

a main high-voltage board and a sub high-voltage board configured to supply a high-voltage current to the unit; and a connecting mechanism configured to electrically connect the main high-voltage board and the sub high-voltage board with the unit, wherein the connecting mechanism includes:

a first connecting member including a main-side terminal configured to be connectable with the main high-voltage board, a unit-side terminal configured to be connectable with the unit and a first conductive wire configured to connect the main-side terminal with the unit-side terminal; and a second connecting member including a sub-side terminal configured to be connectable with the sub high-voltage board, a relay terminal configured to be connectable with the first conductive wire and a second conductive wire configured to connect the sub-side terminal with the relay terminal.

2. The image forming apparatus according to claim 1, wherein the main high-voltage board of one of a plurality of types is configured to be selectively used, in a state where the main high-voltage board of one type is used, the main-side terminal is not connected with the main high-voltage board and the sub high-voltage board is connected with the unit via the second connecting member and the first connecting member, in a state where the main high-voltage board of another type is used, the main-side terminal is connected with the main high-voltage board and the main high-voltage board is connected with the unit via the first connecting member.

3. The image forming apparatus according to claim 1,
wherein the connecting mechanism further includes a holding member configured to hold the first connecting member,
the sub high-voltage board and the second connecting member are attached to the holding member.

4. The image forming apparatus according to claim 3,
wherein the holding member includes:
a first holding plate part to which the first connecting member is detachably attached; and
a second holding plate part to which the sub high-voltage board and the second connecting member are detachably attached, the second holding plate part provided at a side of the first holding plate part.

5. The image forming apparatus according to claim 1,
wherein the sub high-voltage board is provided at a side of the main high-voltage board and adjacent to the main high-voltage board.

6. The image forming apparatus according to claim 1,
wherein the sub-side terminal is at least partially formed by a compressible coil spring,
the relay terminal is at least partially formed by a tension coil spring.

7. The image forming apparatus according to claim 6,
wherein both end parts of the sub-side terminal in an axis center direction are formed by tightly wound coil springs, and
a center part of the sub-side terminal in the axis center direction is formed by the compressible coil spring.

8. The image forming apparatus according to claim 6,
wherein a proximal end side part of the relay terminal is formed by the tension coil spring,
a distal end side part of the relay terminal is formed by a hook and is hooked on the first conductive wire.

9. The image forming apparatus according to claim 1, further comprising:
an image carrier to which a toner image is primarily transferred; and
a secondary transferring member configured to secondarily transfer the toner image on the image carrier to a recording medium,
wherein the unit is an intermediate transferring unit including the image carrier.

* * * * *